US006402348B1

(12) United States Patent
Ouellette et al.

(10) Patent No.: US 6,402,348 B1
(45) Date of Patent: Jun. 11, 2002

(54) LAMP ASSEMBLY AND COUPLER

(75) Inventors: Joseph Ouellette, Hopkinton; Charles Coushaine, Rindge, both of NH (US); Paul Lyman, Brattleboro, VT (US); Frederick A. Peterson, Pembroke, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/598,548

(22) Filed: Jun. 21, 2000

(51) Int. Cl.[7] ..... F21V 7/00; F21V 21/00; H01T 13/28

(52) U.S. Cl. ..... 362/296; 362/396; 362/226; 313/113

(58) Field of Search ..... 362/296, 263, 362/396, 196, 226, 376, 373, 294, 519, 548; 313/113–115

(56) References Cited

U.S. PATENT DOCUMENTS 5,465,025 A * 11/1995 Hendrickson ..... 313/318.09
5,506,471 A * 4/1996 Kosmatka et al. ..... 313/113
5,945,776 A * 8/1999 Koster et al. ..... 313/113

* cited by examiner

*Primary Examiner*—Sandra O'Shea
*Assistant Examiner*—Bao Truong
(74) *Attorney, Agent, or Firm*—William E. Meyer

(57) ABSTRACT

A lamp assembly is provided which includes a lamp/reflector subassembly coupled together by a lamp coupler. The lamp coupler may include two coupler segments which are configured and dimensioned such that the lamp/reflector subassembly may be enclosed within the two coupler segments which may then be latched together. When latched together, the light source of the lamp will be properly positioned relative to the reflector to provide the desired lumen output. Such lamp assembly does not require a costly lamp to reflector focusing operation. A lamp coupler useful in such lamp assembly is also provided.

18 Claims, 5 Drawing Sheets

LAMP ASSEMBLY AND COUPLER

TECHNICAL FIELD

The present invention relates to a lamp coupler useful in coupling together a lamp and a reflector in such a manner as to accurately position the light source of the lamp relative to the reflector. The present invention also relates to a lamp assembly which includes such a lamp coupler. The present invention particularly relates to such a lamp coupler and lamp assembly useful in connection with a high intensity discharge (HID) lamp.

BACKGROUND ART

The lamp coupler and lamp assembly of the present invention is illustrated herein with reference to a lamp subassembly which includes a conventional reflector combined with a conventional high intensity discharge lamp. However, it will be apparent to those skilled in the art that the present invention is not limited to such an application, the lamp coupler of the present invention being useful with other lamp/reflector subassemblies.

The use of a reflector with a lamp is well known. One concern in manufacturing such a lamp is the lamp to reflector focusing operation. Such operation relates to the proper vertical and horizontal positioning of the light source relative to the reflector to achieve maximum average lumen output from the particular lamp assembly. In particular, when a lamp is mounted relative to a reflector, its lumen output will be determined by the position of the light source, such as the arc of an arc tube in a conventional HID lamp, along horizontal and vertical axes of the reflector. Lamp to reflector focusing operations tend to be costly.

DISCLOSURE OF THE INVENTION

It is an object of the present invention to provide an improved lamp assembly.

Another object of the present invention is to provide an improved lamp assembly which obviates the disadvantages of the prior art.

Yet another object of the present invention is to provide an improved lamp assembly which readily fixes the position of the light source relative to the reflector along a horizontal axis of the reflector.

A further object of the present invention is to provide an improved lamp assembly which readily fixes the position of the light source relative to the reflector along a vertical axis of the reflector.

Another object of the present invention is to provide an improved lamp assembly which does not require a costly lamp to reflector focusing operation.

A further object of the present invention is to provide an improved HID lamp assembly which achieves one or more of the foregoing objects.

Yet another object of the present invention is to provide a lamp coupler useful in achieving one or more of the foregoing objects.

This invention achieves these and other objects by providing a lamp coupler for use with a lamp subassembly which includes a lamp, having a lamp axis and a light source, and a reflector having a first reflector axis and a reflective surface. The coupler comprises a first portion adapted to engage the lamp and a second portion adapted to engage the reflector. The first portion and the second portion are structured and arranged to position the light source of the lamp relative to the first reflector axis. The first portion and the second portion may be structured and arranged to position the light source of the lamp along a second reflector axis and offset relative to the first reflector axis, such second reflector axis being perpendicular to the first reflector axis. A lamp assembly including the coupler of the present invention is also provided.

BRIEF DESCRIPTION OF THE DRAWINGS

This invention may be clearly understood by reference to the attached drawings in which like reference numerals designate like parts and in which.

MODE FOR CARRYING OUT THE INVENTION

Figure 1:
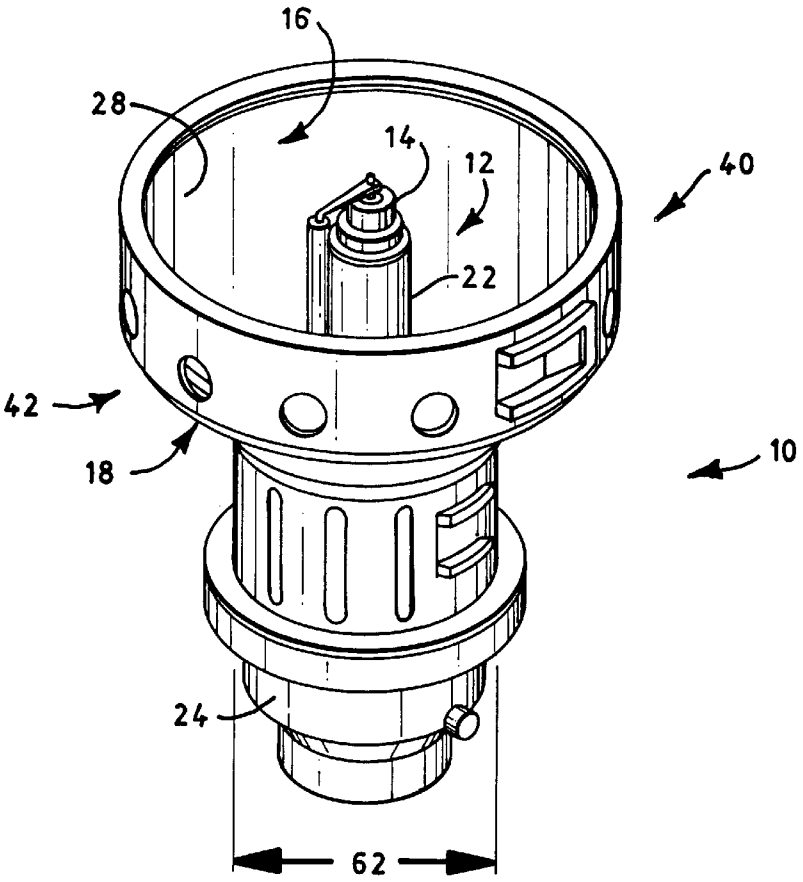
FIG. 1 is a perspective view of one embodiment of a lamp assembly of the present invention.
Figure 2:
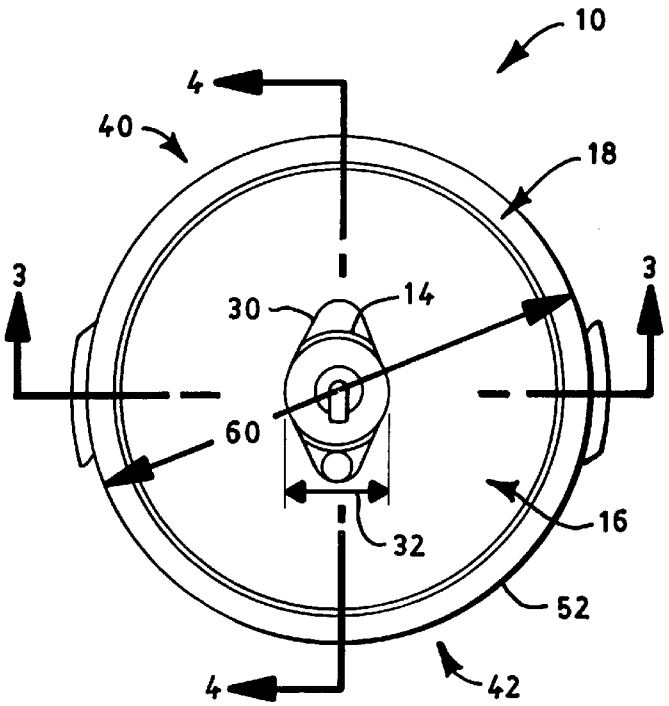
FIG. 2 is a plan view of the front of the lamp assembly of FIG. 1.

For a better understanding of the present invention, together with other and further objects, advantages and capabilities thereof, reference is made to the following disclosure and appended claims taken in conjunction with the above-described drawings.

FIGS. 1 to 4 illustrate one embodiment of a lamp assembly 10 of the present invention. Lamp assembly 10 comprises a lamp subassembly 12, which includes a lamp 14 coupled to a reflector 16, and a lamp coupler 18. Without limitation, coupler 18 may be molded from a resin material. The lamp 14 may be a conventional high intensity discharge lamp which includes an arc tube 20 contained within a glass envelope 22 which is attached to an insulative lamp base 24 fabricated from a resin material in a conventional manner. Without limitation, one example of such a lamp is the standard high intensity discharge (HID) 35 W HID D2 lamp manufactured by Osram Sylvania Inc. The reflector 16 includes a body 26. Without limitation, the body 26 may be fabricated from glass or molded from a resin material. The reflector body 26 includes a reflective surface 28 which reflects light emitted by the arc of the arc tube in a conventional manner. The lamp 14 and reflector 16 are initially coupled together by inserting the envelope 22 through an opening 30 which extends through the reflector. The outer diameter of the tubular envelope 22 and the width 32 of the opening 30 may be such that the envelope may be freely moved within the opening. The coupler 18 is provided in order to obtain optimal positioning of the arc of the arc tube 20 relative to the reflector 16. In particular, the coupler 18 facilitates positioning of the lamp 14 relative to the reflector 16 while inserting the envelope 22 within opening 30 so that the light source or arc of the arc tube 20 will be positioned relative to the reflector along reflector axis 34 to obtain maximum average lumen output from the lamp assembly, as described hereinafter. The reflective surface 28 is symmetrical relative to axis 34.

In considering the lamp assembly of the present invention, the coupler includes a first portion which engages the lamp and a second portion which engages the reflector, the first and second portions being structured and arranged to position the light source along the reflector axis, as desired. For example, the coupler of the present invention may comprise a first portion formed by one interior surface of the coupler at least a portion of which is adapted to engage at least a portion of an exterior surface of the lamp 14, and a second portion formed by another interior surface of the coupler at least a portion of which is adapted to engage at least a portion of an exterior surface of the reflector 16. To this end, the first and second portions are structured and arranged such that the first portion conformally mates with a segment of the lamp 14 and the second portion conformally mates with a segment of the reflector 16 to position the light source or arc of the arc tube 20 along the reflector axis 34 to obtain maximum average lumen output of the lamp assembly 10.

Figure 4:
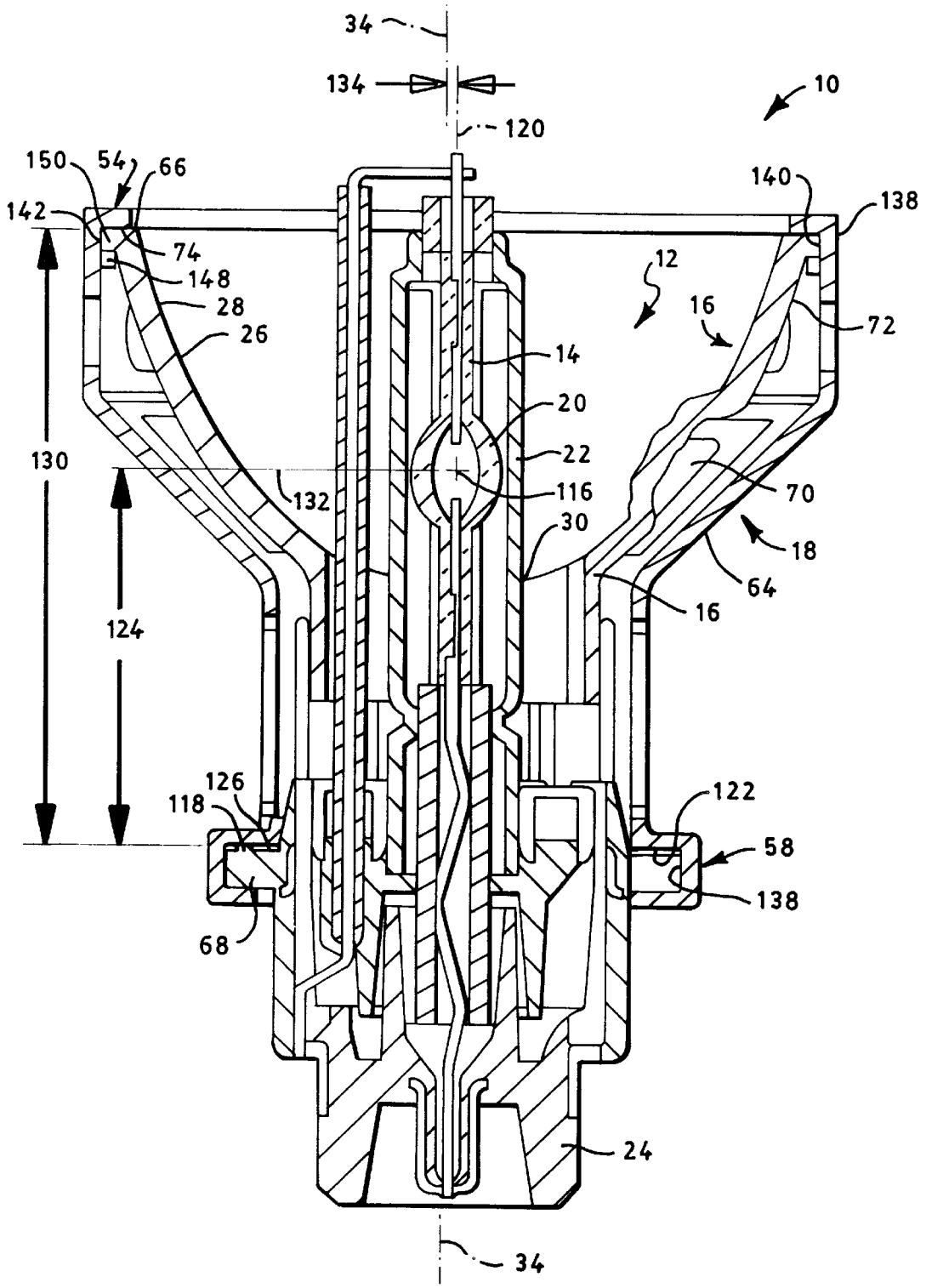
FIG. 4 is a partially cut-away sectional view of FIG. 2 taken along lines 4—4.
Figure 5:
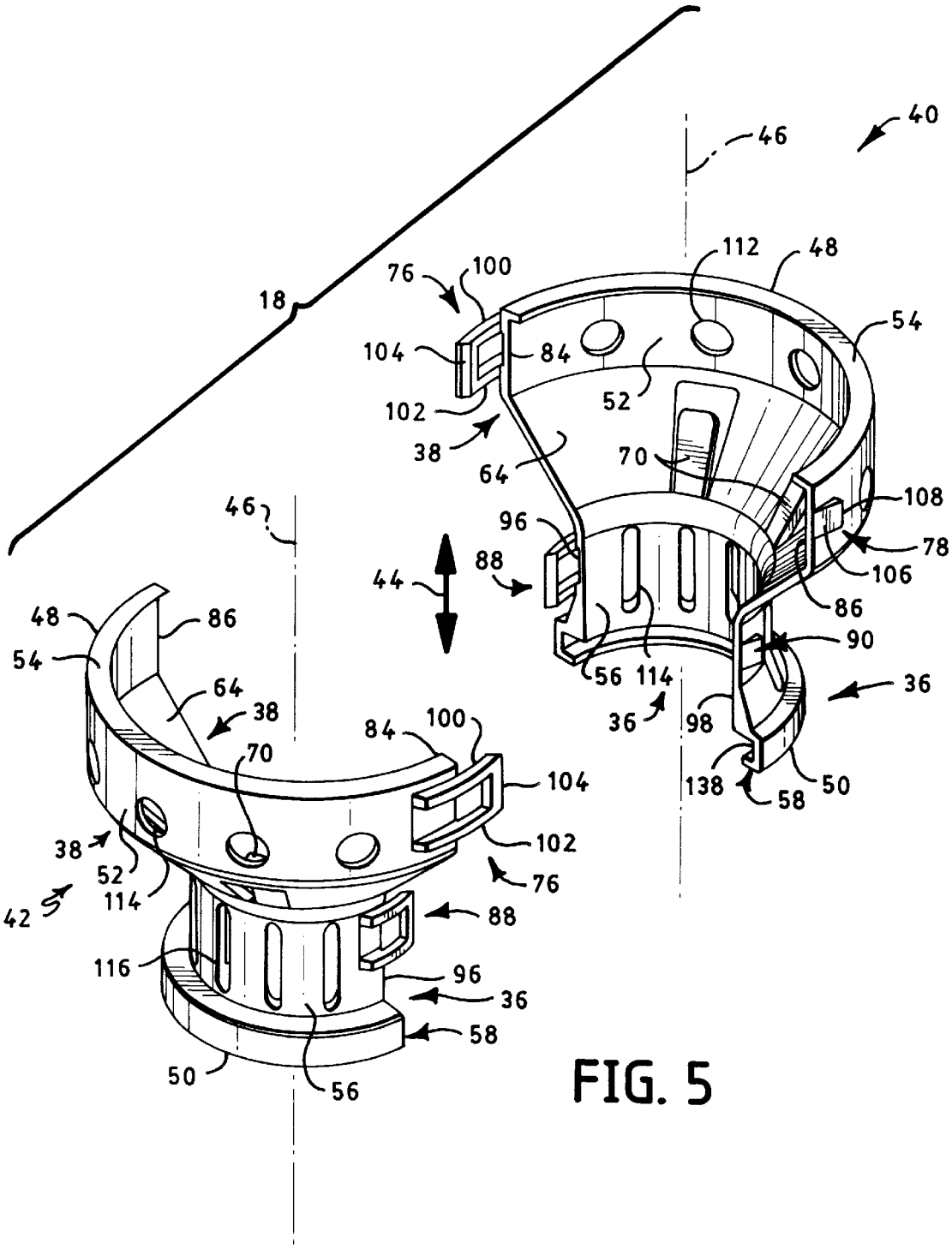
FIG. 5 is an exploded perspective view of one embodiment of a unlatched coupler of the present invention.

In the embodiment illustrated in the drawings, the first and second portions of the coupler 18 are formed by first portions 36 and second portions 38 of a first coupler segment 40 and a second coupler segment 42. Without limitation, in the embodiment illustrated in FIGS. 1 to 5, the coupler segments 40 and 42 are substantially identical, except as described herein. With reference to FIG. 5, each coupler segment 40, 42 extends in the direction 44 of a coupler axis 46 from a front coupler end 48 to a rear coupler end 50. When the coupler segments 40,42 are assembled with the lamp/reflector subassembly 12, the respective coupler axes 46 will be coincident with each other and with the reflector axis 34. The coupler segments 40,42 are structured and arranged to enclose the lamp 14 and reflector 16 when the coupler segments are latched together, as described hereinafter.

Figure 3:
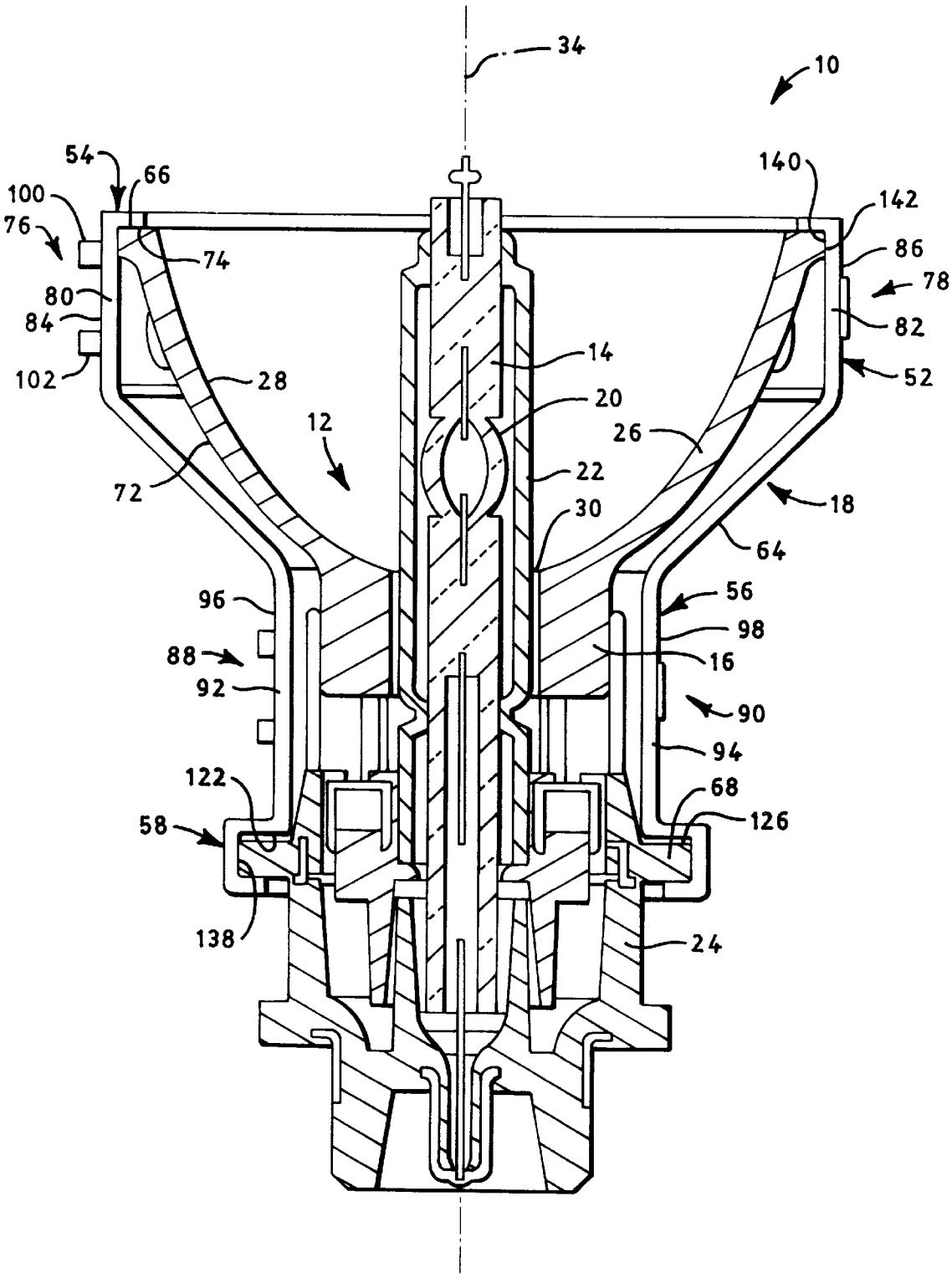
FIG. 3 is a sectional view of FIG. 2 taken along lines 3—3.

With reference to FIG. 5, each second portion 38 of each coupler segment 40, 42 comprises a semi-cylindrical wall 52 which is parallel to the axis 46 and includes a flanged region 54 including a flange extending towards axis 46 at the front coupler end 48. Each first portion 36 of each coupler segment 40,42 comprises a semi-cylindrical wall 56 which is parallel to the axis 46 and includes a recess 58 which opens towards axis 46 at the rear coupler end 50. The walls 52 and 56 have respective diameters of 60 (FIG. 2) and 62 (FIG. 1), the diameter 62 being less than the diameter 60. The walls 52 and 56 are joined by a bridging wall 64 which extends at an angle relative to axis 46. When the coupler segments 40, 42 are latched together as described herein, the coupler 18 will be completed and will include a circumferentially extending flanged portion 54 and a circumferentially extending recess 58. With reference to FIGS. 3 and 4, when lamp assembly 10 is completed as described herein, the circumferentially extending flanged portion 54 formed by coupler segments 40,42 will conformally mate with a circumferentially extending front edge 66 of the reflector 16. In addition, the circumferentially extending recess 58 formed by coupler segments 40,42 will conformally mate with a circumferentially extending base flange 68 of the lamp base 24 of lamp 14 to hold the lamp in place relative to the coupler.

The coupler of the present invention comprises a resilient third portion positioned between the first and second coupler portions, such third portion being structured and arranged to be biased against an external surface of the reflector when the coupler is coupled to the lamp/reflector subassembly to thereby urge the reflector against the second portion of the coupler. For example, in the embodiment illustrated in FIG. 5, each coupler segment comprises a third portion in the form of a plurality of resilient fingers 70 which extend from the bridging wall 64 towards the coupler axis 46. With reference to FIG. 4, the resilient fingers 70 are structured and arranged such that when the coupler segments 40,42 are coupled to the lamp/reflector subassembly, the fingers (a) form the third portion of the coupler and (b) are depressed by the exterior surface 72 of the reflector 16 and thereby biased against the exterior surface of the reflector. In this manner, the fingers 70 will urge the front edge 66 of the reflector 16 against the surface 74 of coupler flange 54 thereby holding the reflector in place relative to the coupler 18. Since the fingers 70 serve to hold the reflector 16 in place relative to the coupler 18, and the mating of the recess 58 and lamp base flange 68 serves to hold the lamp 14 in place relative to the coupler, the reflector and lamp will be held in place relative to each other.

The coupler segments of the present invention are structured and arranged to be latched together when they are coupled to a lamp/reflector subassembly. To this end, one coupler segment may include one or more latch which mates with a respective one or more mating latch of the other coupler segment to latch the coupler segments together. When latched together, the coupler segments of the present invention may encircle a portion of the lamp and/or a portion of the reflector. For example, in the embodiment illustrated in FIGS. 1 to 4, the coupler segments 40,42 may be latched together to encircle a portion of the lamp 14 and a portion of reflector 16 as illustrated in the drawings. In particular, each coupler segment 40,42 comprises a first latch 76 and a second latch 78 adjacent respective first and second interface surfaces 80 and 82 at respective opposite edges 84 and 86 of the semi-cylindrical wall 52. Similarly, each coupler segment 40,42 comprises a third latch 88 and a fourth latch 90 adjacent respective third and fourth interface surfaces 92 and 94 at respective edges 96 and 98 of the semi-cylindrical wall 56. Without limitation, each latch 76 may comprise resilient arms 100,102 which are cantilevered from the wall 52 at edge 84 and are joined by a bridge member 104. Each latch 78 is in the form of a ramp having a ramp surface 106 and an abutment surface 108. Since the coupler segments 40,42 are identical in this respect, when they are coupled to the lamp subassembly 12, each latch 76 will engage a respective latch 78. To this end, latches 76 and 78 are structured and arranged such that the bridge member 104 will engage a ramp surface 106 and thereby flex away from the coupler axis 46 until the coupler segments 40,42 are completely assembled to form the coupler 18, at which time the ramp will extend between the resilient arms 100, 102 as the arms resile towards the coupler axis. In this manner, the bridge member 104 engages the abutment surface 108 to lock the coupler segments together. The latches 88 and 90 are identical to, and function in the same manner as, the latches 76 and 78, with the exception that latches 88 and 90 are somewhat shorter in length than latches 76 and 78.

Each coupler segment 40,42 may include openings such as circular openings 114 and elongated openings 116. Such openings provide ventilation for the lamp assembly 12 enclosed by the coupler 18.

Figure 6:
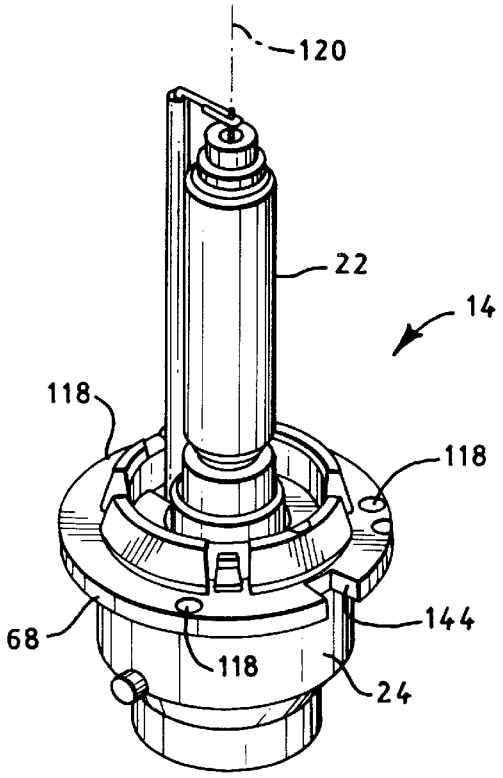
FIG. 6 is a perspective view of one embodiment of a lamp useful with the lamp assembly of the present invention.
Figure 7:
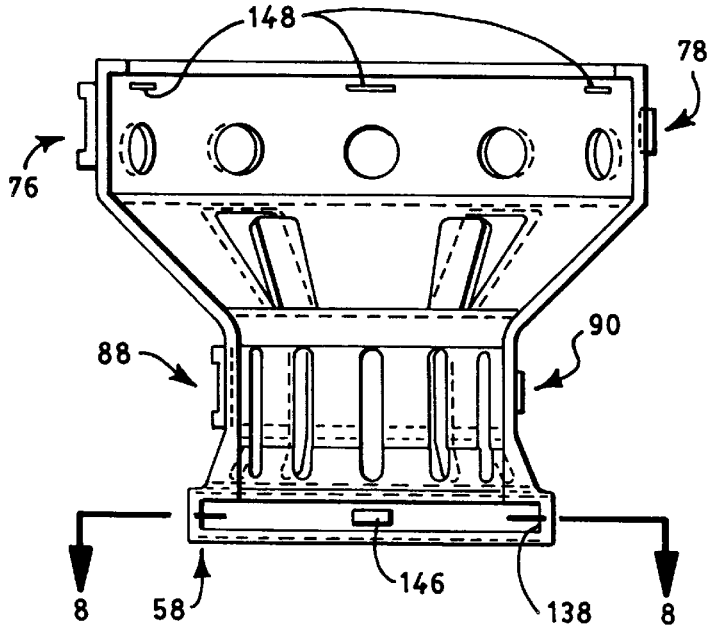
FIG. 7 is a side view looking into a coupler segment of one embodiment of the coupler of the present invention.
Figure 8:
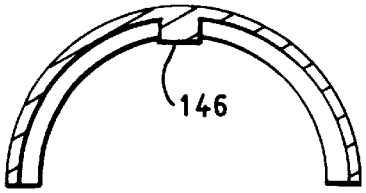
FIG. 8 is a view of FIG. 7 taken along lines 8—8.

With reference to FIG. 4, lamp base 24 comprises at least one dimple 118 protruding from the base flange 68. In the embodiment illustrated in the drawings, there are three dimples 118 equally spaced circumferentially about the lamp axis 120 as illustrated in FIG. 6. Each dimple 118 engages a reference surface 122 of the recess 58. In those instances where no dimples are provided, the surface 126 of the base flange 68 engages the reference surface 122. In this manner, surface 122 of recess 58 provides a reference surface for the base 68 useful in locating the arc 116 relative to the axis 34; that is, the engagement of the lamp base 68 within the coupler recess 58 will hold the lamp 14 in place relative to the coupler at the desired location along axis 34. The distance 130 between the flange surface 74, which provides a reflector reference surface, and the surface 122 will determine the position of the reflector 16 along axis 34. In particular, when the lamp/reflector subassembly 12 is coupled to the coupler 18, the engagement of the front edge 66 of the reflector 16 with the surface 74 will fix the position of the reflective surface 28 relative to the reflector axis 34. The resilient fingers 70 urge the reflector 16 against surface 74 thereby holding the reflector in place relative to the coupler 18 and the arc 116 of the lamp 12 to fix the position of the reflective surface 28 relative to the arc along axis 34. In such embodiment, the reflector will be axially symmetrical relative to the coupler axis 46, axis 46 being coincident with axis 34.

With reference to FIG. 4, the reflector 16 has a second reflector axis 132 which is perpendicular to the first reflector axis 34. Typically, axis 34 is referred to as the horizontal reflector axis, and axis 132 is referred to as the vertical reflector axis. In the embodiment illustrated in FIG. 4, the light source or arc 116 of the lamp 14 is positioned along axis 132. Lamp axis 120, and therefore arc 116, is also offset a distance 134 relative to the axis 34. Such offset may be desirable in order to compensate for the bowed arc characteristically present in some lamps. For example, in one embodiment of the present invention, an upwardly bowed arc 116 was compensated for by lowering the lamp axis 120, and therefore the position of the arc, relative to axis 34 a distance 134 along axis 132 equal to about 0.024 inches. To provide for such offset, each first portion 36 of the coupler 18 comprises a first interior surface of the coupler which is asymmetrical relative to the coupler axis 46, and each second portion 38 of the coupler 18 comprises a second interior surface of the coupler which is symmetrical relative to the coupler axis. In such embodiment, each first interior surface mates with the lamp and each second interior surface mates with the reflector. For example, in the embodiment illustrated in the drawings, when the coupler segments 40,42 are latched together, the recesses 58 combine to form a circumferentially extending base surface 138 which is asymmetrical relative to the coupler axis 46. Similarly, a circumferentially extending coupler inner surface 140 is formed which is symmetrical relative to the coupler axis 46. When the coupler segments 40,42 are coupled together to enclose the lamp subassembly 12, the base flange 68 mates with the asymmetrical recess base surface 138, and the portion 142 of the outer surface 72 of the reflector 16 mates with the symmetrical inner surface 140. Assembling the lamp assembly 10 in this manner will offset the lamp axis 120, and therefore the arc 116, relative to horizontal reflector axis 34 along vertical reflector axis 132. In order for the light source or arc 116 to have the correct angle of rotation relative to the lamp axis 120, the lamp and the coupler are keyed together. To this end, in the embodiment illustrated in the drawings, the lamp base 68 is provided with a keyway 144 which mates with a key 146 extending from the coupler base surface 138 of one of the coupler segments. Since the lamp base 68 includes only one keyway 144, only one coupler segment need be provided with a mating key 146. In the embodiment illustrated in the drawings only coupler segment 40 is provided with a mating key 146, and to this extent coupler segment 40 differs from coupler segment 42.

In assembling the lamp assembly 10 of the present invention, the lamp subassembly 12 is inserted into the coupler segment 40 such that the base 68 mates with recess 58, including the coupler base surface 138, and the portion 142 of the outer reflector surface 72 mates with the inner surface 140. The inner surface 140 of each coupler segment may include a plurality of tabs 148 which extend towards coupler axis 46 and are spaced from the inner surface 74 of the flanged region 54. In addition, the front end of the reflector may include a flanged region 150 which includes the front edge 66 and portion 142. In such an embodiment, when inserting the lamp subassembly 12 into the coupler segment 40, the flanged region 150 may be inserted between the surface 74 and the tabs 148. The lamp 14 is rotated relative to the lamp axis 120 until the key 146 extends into the keyway 144. Then the coupler segment 42 is coupled to the lamp subassembly 12 and coupler segment 40 by inserting the subassembly into the coupler segment 42 such that the base 68 mates with recess 58 of coupler segment 42, including coupler base surface 138, and the portion 142 of the outer reflector surface 72 engages the coupler inner surface 140. To this end, the flanged region 150 of the reflector is inserted between surface 74 and the tabs 148 of coupler 42. When in this position, the coupler segments 40 and 42 are latched together as described herein. Such latching operation causes the resilient fingers 70 to be depressed by exterior surface 72 of reflector 16 and thereby be biased against the surface 72 to urge the front edge 66 of the reflector against the surface 74 of the flanged region 54 thereby holding the reflector in place relative to the coupler 18 and the lamp 14. Upon assembly in this manner, the arc 116 will be positioned along reflector axis 34, and offset along reflector axis 132 a distance 134, to provide optimum focussing.

Enclosing the lamp subassembly 12 within the coupling halves 40,42, and latching the coupling halves together thereby forming the coupler 18, permits easy assembly of the components and provides a manner which (a) readily and accurately fixes the position of the light source relative to the reflector along the horizontal and vertical axes of the reflector to obtain maximum average lumen output from the lamp assembly, and (b) does not require a costly lamp to reflector focusing operation.

The actual focused location of the light source relative to the reflector will depend upon the nature of the particular lamp and reflector being used and can be determined in a conventional manner.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A lamp assembly, comprising:

a lamp having a lamp axis and a light source;

a reflector coupled to said lamp and comprising a first reflector axis and a reflective surface; and a coupler comprising a first portion engaging said lamp and a second portion engaging said reflector, said first portion and said second position being structured and arranged to position said light source of said lamp relative to said first reflector axis, wherein said first portion comprises a recess and said lamp comprises a base having a flange which mates with said recess, and further wherein said second portion comprises a flanged region, at least a portion of said flanged region mating with a front edge of said reflector.

2. A lamp assembly, comprising:

a lamp having a lamp axis and a light source;

a reflector coupled to said lamp and comprising a first reflector axis and a reflective surface; and a coupler comprising a first portion engaging said lamp and a second portion engaging said reflector, said first portion and said second position being structured and arranged to position said light source of said lamp relative to said first reflector axis, wherein said coupler comprises a resilient third portion positioned between said first portion and said second portion, said third portion being biased against an external surface of said reflector to urge said reflector against said second portion.

3. A lamp assembly, comprising:

a lamp having a lamp axis and a light source;

a reflector coupled to said lamp and comprising a first reflector axis and a reflective surface; and a coupler comprising a first portion engaging said lamp and a second portion engaging said reflector, said first portion and said second position being structured and arranged to position said light source of said lamp relative to said first reflector axis, wherein said coupler comprises a first coupler segment extending in the direction of a coupler axis from a front end of said coupler to a rear end of said coupler, and a second coupler segment extending in said direction from said front end to said rear end, said first coupler segment and said second coupler segment being latched together.

4. The lamp assembly of claim 3 wherein said first coupler segment includes at least one latch and said second coupler segment includes at least one mating latch, said first coupler segment being latched to said second coupler segment at said latch and said mating latch to encircle at least a portion of said lamp.

5. The lamp assembly of claim 3 wherein said first coupler segment includes at least one latch and said second coupler segment includes at least one mating latch, said first coupler segment being latched to said second coupler segment at said latch and said mating latch to encircle at least a portion of said reflector.

6. The lamp assembly of claim 3 wherein said first and second coupler segments each comprises a first latch and a second latch adjacent a respective first and second interface surface, and a third latch and a fourth latch adjacent a respective third and fourth interface surface, each first and second latch of said first coupler segment being latched to a respective third and fourth coupler latch of said second segment, and each first and second latch of said second coupler segment being latched to a respective third and fourth coupler latch of said first segment.

7. The lamp assembly of claim 1 wherein said reflector comprises a second reflector axis perpendicular to said first reflector axis, said light source of said lamp being positioned along said second reflector axis and being offset relative to said first reflector axis.

8. The lamp assembly of claim 7 wherein said first portion comprises a first interior surface of said coupler asymmetrical relative to a coupler axis, and said second portion comprises a second interior surface of said coupler symmetrical relative to said coupler axis, said first interior surface mating with said lamp and said second interior surface mating with said reflector.

9. The lamp assembly of claim 8 wherein said lamp and said first interior surface are keyed together.

10. A coupler, for use with a lamp subassembly which includes a lamp, having a lamp axis and a light source, and a reflector having a first reflector axis and a reflective surface, comprising, a first portion adapted to engage said lamp and a second portion adapted to engage said reflector, said first portion and said second portion being structured and arranged to position said light source of said lamp relative to said first reflector axis, wherein said first portion comprises a recess structured and arranged to mate with a lamp base flange, and further wherein said second portion comprises a flanged region, at least of portion of said flanged region being structured and arranged to mate with a front edge of said reflector.

11. A coupler, for use with a lamp subassembly which includes a lamp, having a lamp axis and a light source, and a reflector having a first reflector axis and a reflective surface, comprising, a first portion adapted to engage said lamp and a second portion adapted to engage said reflector, said first portion and said second portion being structured and arranged to position said light source of said lamp relative to said first reflector axis, wherein said coupler comprises a resilient third portion positioned between said first portion and said second portion, said third portion being structured and arranged to be biased against an external surface of said reflector to urge said reflector against said second portion.

12. A coupler, for use with a lamp subassembly which includes a lamp, having a lamp axis and a light source, and a reflector having a first reflector axis and a reflective surface, comprising, a first portion adapted to engage said lamp and a second portion adapted to engage said reflector, said first portion and said second portion being structured and arranged to position said light source of said lamp relative to said first reflector axis, comprising a first coupler segment extending in the direction of a coupler axis from a front coupler end to a rear coupler end, and a second coupler segment extending in said direction from said front coupler end to said rear coupler end, said first coupler segment and said second coupler segment being structured and arranged to be latched together.

13. The coupler of claim 12 wherein said first coupler segment includes at least one latch and said second coupler segment includes at least one mating latch, said first and second coupler segments being structured and arranged to be latched together at said latch and said mating latch to encircle at least a portion of said lamp.

14. The coupler of claim 12 wherein said first coupler segment includes at least one latch and said second coupler segment includes at least one mating latch, said first and second coupler segments being structured and arranged to be latched together at said latch and said mating latch to encircle at least a portion of said reflector.

15. The coupler of claim 12 wherein said first coupler segment and said second coupler segment each comprise a first latch and a second latch adjacent a respective first and second interface surface, and a third latch and a fourth latch adjacent a respective third and fourth interface surface, said first and second latch of said first coupler segment being structured and arranged to latch with a respective third and fourth latch of said second coupler segment, and said first and second latch of said second coupler segment being structured and arranged to latch with a respective third and fourth latch of said first coupler segment.

16. The coupler of claim 10 wherein said first portion and said second portion are structured and arranged to position said light source of said lamp along a second reflector axis and offset relative to said first reflector axis, said second reflector axis being perpendicular to said first reflector axis.

17. The coupler of claim 16 wherein said first portion comprises a first interior surface of said coupler asymmetrical relative to a coupler axis, and said second portion comprises a second interior surface of said coupler symmetrical relative to said coupler axis, said first interior surface being structured and arranged to mate with said lamp and said second interior surface being structured and arranged to mate with said reflector.

18. The coupler of claim 17 wherein said recess is structured and arranged to be keyed together with said base of said lamp to fix the position of said light source along said second reflector axis.

* * * * *